US006019023A

United States Patent [19]

Betourne

[11] Patent Number: 6,019,023

[45] **Date of Patent: *Feb. 1, 2000**

[54] CUTTING MACHINE USING A ROTARY WHEEL FOR CUTTING A FLEXIBLE MATERIAL CONSISTING OF A SINGLE SHEET OR A SMALL MAT OF SHEETS, AND METHOD FOR ADJUSTING SAID MACHINE

[75] Inventor: Rene Betourne, Toulouse, France

[73] Assignee: Digital Controls, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/581,548

[22] PCT Filed: Jul. 7, 1993

[86] PCT No.: PCT/FR93/00702

§ 371 Date: Jun. 19, 1996

§ 102(e) Date: Jun. 19, 1996

[87] PCT Pub. No.: WO95/01855

PCT Pub. Date: Jan. 19, 1995

[51] Int. Cl.[7] ..... B26D 7/12

[52] U.S. Cl. ..... 83/174; 83/941; 451/195; 451/196; 451/293

[58] Field of Search ..... 83/174, 174.1, 83/940, 941; 451/190, 192, 195, 196, 197, 198, 268, 269, 293

[56] References Cited

U.S. PATENT DOCUMENTS

| | | | |
|---|---|---|---|
| 3,181,406 | 5/1965 | Sayles | 83/174 |
| 3,507,177 | 4/1970 | Baldwin | 83/174 |
| 3,719,113 | 3/1973 | Gerber et al. | 83/174 |
| 3,776,072 | 12/1973 | Gerber et al. | 83/34 |
| 3,868,795 | 3/1975 | Rees | 83/174.1 |
| 4,133,233 | 1/1979 | Pearl | 83/174 |
| 4,133,235 | 1/1979 | Gerber | 83/174 |
| 4,201,101 | 5/1980 | Gerber | 83/174.1 |
| 4,643,061 | 2/1987 | Gerber et al. | 83/174.1 |
| 4,762,040 | 8/1988 | Perez et al. | 83/174 |
| 4,841,822 | 6/1989 | Gerber | 83/174 |
| 5,090,281 | 2/1992 | Paulson et al. | 83/174 |
| 5,303,515 | 4/1994 | Etcheparre et al. | 83/174 |

FOREIGN PATENT DOCUMENTS

| | | |
|---|---|---|
| 2 582 247 | 1/1986 | France . |
| 2 582 564 | 2/1986 | France . |
| 500 055 | 3/1969 | Switzerland . |
| 2 098 108 | 4/1982 | United Kingdom . |

*Primary Examiner*—M. Rachuba
*Assistant Examiner*—Sean Pryor
*Attorney, Agent, or Firm*—Jones & Askew LLP

[57] ABSTRACT

The invention relates to a cutting machine for cutting a flexible material by a cutting wheel rotated by a motor. The cutting wheel and the motor are carried by a cutting head mounted to move horizontally along two orthogonal axes and to rotate about a vertical tangential servo-control axis. The invention further includes a support table covered with a mat into which the cutting wheel penetrates. The cutting wheel is adjustable to change the depth to which the cutting wheel penetrates into the mat. The cutting wheel is also adjustable to change the horizontal distance between the vertical tangential servo-control axis and the axis rotation of the cutting wheel so that the cutting wheel penetrates into the mat a front contact point situated in the vicinity of the tangential servo-control axis.

2 Claims, 5 Drawing Sheets

CUTTING MACHINE USING A ROTARY WHEEL FOR CUTTING A FLEXIBLE MATERIAL CONSISTING OF A SINGLE SHEET OR A SMALL MAT OF SHEETS, AND METHOD FOR ADJUSTING SAID MACHINE

TECHNICAL FIELD

The invention relates to a cutting machine for cutting a flexible material by means of a rotary cutting wheel, the material being in particular in the form of a single ply or of a small lay-up of plies. It also relates to a method of adjusting such a cutting machine.

BACKGROUND OF THE INVENTION

Cutting machines provided with rotary cutting wheels are commonly used for cutting flexible materials in the form of a single ply or of a small lay-up of plies. Such machines are described in particular in patents FR 2,582,564, FR 2,582,247, and U.S. Pat. No. 3,776,072, and each such machine includes a table-top provided with a support surface for supporting the flexible material, and a cutting head provided with a cutting wheel, with a drive motor for rotating said cutting wheel, and with means for sequentially sharpening said cutting wheel. Furthermore, horizontal drive means are adapted so as to displace the cutting head horizontally above the table-top along two orthogonal displacement axes, and rotary drive means are adapted so as to rotate said head around a vertical tangential servo-control axis.

Moreover, such cutting machines are provided with means for holding the flexible material on the support table-top in a fixed position during the entire cutting process. Such holding means conventionally comprise a support surface constituted by a bristle bed provided with a large number of vertical air-flow passages, and suction means adapted so as to create suction that holds the flexible material against the support surface.

Although such means are entirely satisfactory with respect to holding the flexible material while it is being cut, they suffer from two major drawbacks. Firstly, it is necessary to provide each cutting machine with a specific support surface, and in particular with suction means, which both increase the cost of such machines, and also have non-negligible operating costs with respect to energy consumption. Secondly, holding the material by suction makes it necessary to interpose both a perforated sheet between the support surface and the flexible material so that flexible material is not sucked in, and also another sheet on top of the flexible material so as to provide air-tightness. These sheets, which are unavoidably cut up at the same time as the flexible material, must be replaced after each cutting operation, and they therefore constitute consumables whose cost is non-negligible.

SUMMARY OF THE INVENTION

An object of the present invention is to mitigate those drawbacks, and a main object of the invention is to provide a cutting machine of the type including a rotary cutting wheel, which machine needs no special holding apparatus, such as suction means, etc. for holding the flexible material on the support surface.

Another object of the invention is to provide a cutting machine provided with improved sharpening apparatus providing excellent sharpening quality.

Another object of the invention is to provide a cutting machine designed so that the flexible material to be cut is automatically supplied onto the support surface.

Another object of the invention is to provide a cutting machine that automatically positions the flexible material transversely on the support surface, and that automatically controls the position of the flexible material relative to the cutting head.

To this end, the invention provides a cutting machine for cutting a flexible material in particular in the form of a single ply or of a lay-up of plies, the cutting machine including:

- a table-top provided with a support surface for supporting the flexible material to be cut;
- a cutting head provided with a cutting wheel, a drive motor for rotating said cutting wheel, and sharpening means for sequentially sharpening said cutting wheel;
- horizontal drive means for horizontally displacing the cutting head above the table-top along two orthogonal displacement axes; and
- rotary drive means for rotating the cutting head about a vertical "tangential servo-control" axis.

According to the invention, said cutting machine is characterized in that:

- the table-top is covered with a support material of predetermined thickness into which the cutting wheel can penetrate easily;
- the cutting head is associated with a carriage to which it is connected via vertical displacement means capable of displacing said head between a top position in which the cutting wheel is at a distance above the table-top, and a bottom position in which said cutting wheel penetrates to a predetermined depth into the support material;
- vertical adjustment means are adapted so as to make it possible to adjust the bottom position of the cutting head, and therefore the depth to which the cutting wheel penetrates into the support material;
- the drive motor for rotating the cutting wheel is carried by the cutting head and is capable of rotating said cutting wheel at a speed greater than 5,000 r.p.m., said motor and said cutting wheel being respectively provided with a drive shaft and an axis of rotation that are parallel and horizontal;
- the rotary drive means for rotating the cutting head are organized so that the tangential servo-control axis of the cutting wheel is offset horizontally at a distance (D) relative to the axis of rotation thereof, so that said cutting wheel penetrates into the support material at a front contact point situated in the vicinity of said tangential servo-control axis; and
- horizontal adjustment means are adapted so as to make it possible to adjust the distance (D) between the tangential servo-control axis and the axis of rotation of the cutting wheel.

All of these characteristics contribute to providing a cutting machine that creates no force on the flexible material other than the cutting force, which, in addition, is extremely attenuated because firstly the speed of rotation of the cutting wheel is high, secondly said cutting wheel is sharpened regularly, and thirdly the front contact point of said cutting wheel is positioned in the vicinity of the tangential servo-control axis.

Practically, such a machine makes it unnecessary to hold the flexible material by suction or by any other method, so that, while it is being cut, the flexible material is held merely by it adhering to its support, when the flexible material is single-ply, or by the layers adhering to one another when the material is in the form of a small lay-up.

The method of adjusting the position of the cutting wheel of such a cutting machine advantageously consists in:

determining a given penetration depth by adjusting the means for adjusting the bottom position of the cutting head;

lowering the cutting wheel into bottom abutment, while it is rotating, so as to obtain a first line of impact;

raising the cutting wheel again and causing the cutting head to be rotated through 90 degrees;

lowering the cutting wheel again into bottom abutment, while it is rotating, so as to obtain a second line of impact that is orthogonal to the first line of impact;

examining the lines of impact so as to determine the lengths of the lines extending beyond their point of intersection; and actuating the horizontal adjustment means in one direction or the other so as to obtain an impact line length beyond the point of intersection of the impact lines lying substantially in the range 0.5 mm to 2 mm.

Thus, regardless of the position of the bottom abutment for the cutting wheel, and therefore regardless of the depth to which it penetrates into the support material, the front contact point of the cutting wheel is positioned substantially on the tangential servo-control axis, but with a small offset forwards relative thereto.

In this way, the cutting force is extremely attenuated (since the front contact point lies substantially on the tangential servo-control axis, the flexible material is no longer "chopped"), while also covering the risk of a few threads of flexible material being left caught (the front contact point of the cutting wheel is offset slightly forwards).

According to another characteristic of the invention, the sharpening means comprise:

two whetting members, each of which is provided with a respective whetting face, and is disposed facing a respective face of the cutting wheel, one of said whetting members being adapted so as to give the cutting wheel its cutting angle, and the other whetting member being adapted so as to perform a thread-cutting function; and means for displacing the whetting members so as to press their whetting faces periodically and for a predetermined time against the corresponding faces of the cutting wheel.

Such sharpening means make it possible to obtain excellent sharpening quality, which tends to reduce the cutting force still further.

Furthermore, in a preferred embodiment, the whetting members are disposed such that their whetting faces form different respective angles of inclination with the corresponding faces of the cutting wheel, and such that the contact area between the sharpening whetting member and the cutting wheel is smaller than the contact area between the other whetting member and said cutting wheel.

In addition, according to another characteristic of the invention, the contact zone between the whetting face of each whetting member and the corresponding face of the cutting wheel is eccentric relative to the center of the whetting face, so that, on contact, the rotation of said cutting wheel rotates said whetting members.

In a preferred embodiment, the cutting head comprises:

a "fixed" element carried by the carriage via vertical displacement means, and to which the drive motor for rotating the cutting wheel is secured;

a "moving" element, referred to as a "slide", carrying the cutting wheel; and manual means for displacing the slide relative to the fixed element, which means are adapted so as to adjust the distance (D).

According to another characteristic of the invention:

the cutting wheel is carried by a horizontal shaft on which a pulley is mounted, the shaft extending along an axis that is orthogonal to the displacement axis of the slide;

the drive motor for rotating the cutting wheel includes a drive shaft carrying a pulley, the drive shaft being parallel to the shaft of the cutting wheel; and a drive belt constituted by an O-ring is mounted around said pulleys.

By using an O-ring, which is resilient, this disposition makes it simple to accommodate movement of the slide.

In preferred embodiments of the invention aiming to provide a cutting machine in which the flexible material is automatically supplied onto the support surface, firstly:

the table-top is constituted by an endless belt having a supporting top surface and mounted around two rollers;

the support material is secured to the belt over the entire surface thereof; and drive means are adapted so as to cause a given length of belt to be advanced on command.

In addition, a clamping bar is associated with the gantry and is provided with vertical displacement means capable of pressing it against the belt, the drive means for displacing the gantry and the drive means for displacing the belt being adapted so as to displace the belt and the gantry in synchronized manner.

Furthermore, the cutting machine is preferably provided with means adapted so that the flexible material is automatically positioned transversely on the support surface, on supplying said flexible material, which means include:

support means for supporting a roller for supplying a sheet of flexible material, which means are adapted so as to make it possible to deliver said sheet to the belt;

detection means for detecting a side edge of the sheet of flexible material supplied to the belt; and transverse displacement means for transversely displacing the support means for supporting the supply roller, which means are adapted so as to position said roller as a function of the information delivered by the detection means.

Other characteristics, objects, and advantages of the invention appear from the following detailed description of a preferred embodiment of the invention given by way of non-limiting example and with reference to the accompanying drawings which are integral parts of the present description and in which:

Figure 9:
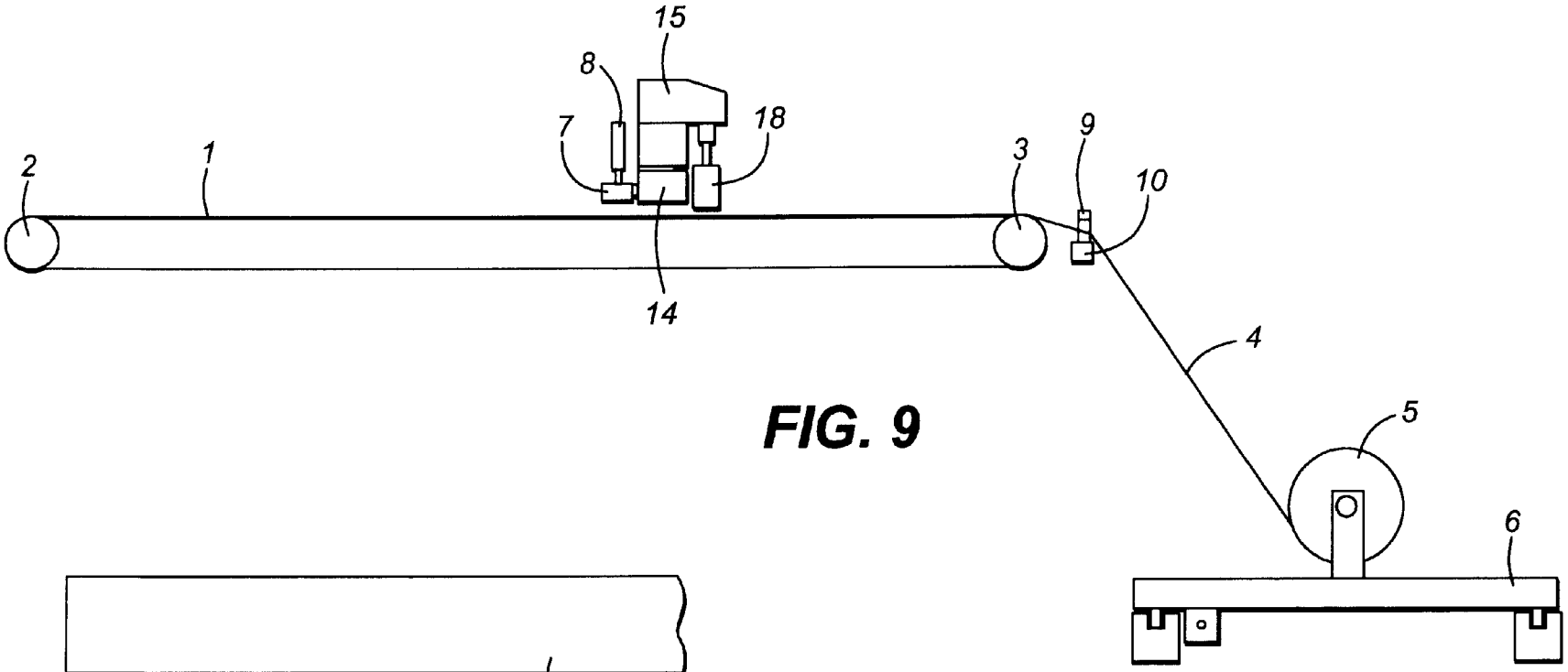
FIG. 9 is a diagram showing a cutting machine of the invention.

The cutting machine shown diagrammatically in FIG. 9 is designed for automatically cutting a flexible material which is in the form of a single ply or of a small lay-up of plies.

DETAILED DESCRIPTION OF THE INVENTION

The machine in FIG. 9 includes a cutting table, supply means 5 for supplying a strip of flexible material 4, a cutting head 18 carrying a cutting wheel, and means for displacing the cutting head in translation, which means comprise a gantry 14 mounted so as to move longitudinally over the cutting table and a carriage 15 mounted on the gantry so as to move longitudinally thereon, i.e. orthogonally relative to the displacement direction of said gantry. The cutting machine also conventionally includes a numerical control unit (not shown) adapted so as to control all of the operating parameters of said machine.

The cutting table includes a framework (not shown) carrying an endless belt 1 made of a material such as PVC, mounted around two rollers 2 and 3, one of said rollers being associated with drive means of any type known per se (not shown) and adapted so as to cause the belt 1 to advance.

Furthermore, the entire surface of the belt 1 is covered with a foam mat (not shown) made of an expanded material such as polyurethane foam into which the cutting wheel can penetrate easily. The foam mat is intended to be changed regularly, and it is, for example, fixed to the belt by means of a double-sided adhesive tape (not shown).

The cutting machine further includes means for supplying a strip of flexible material 4 from a roller 5 carrying a roll of said material.

The supply means include a frame 6 for supporting the roller 5 carrying the flexible material, and disposed so as to extend the belt 1 longitudinally.

The supply means also include a clamping bar 7 associated with the gantry and extending parallel thereto. The clamping bar 7 is carried in the vicinity of each of its ends by the rod of a respective vertically-organized pneumatic actuator 8 whose body is secured to the gantry, the actuators being adapted so as to press said clamping bar against the belt 1 on being extended.

Once a width of flexible material 4 to be cut has been clamped between the clamping bar 7 and the belt 1, a length of flexible material can then be supplied onto the top surface of the belt by displacing the gantry and, advancing the belt 1 simultaneously and in synchronized manner.

It should be noted that all the displacements of the belt 1 are digitized so as to enable cutting to be interrupted and then subsequently resumed at exactly the same location, and so as to enable the length of flexible material used to be controlled, etc.

The paying-out means (not shown) finally include transverse-centering means (not shown) adapted so as to center the strip of material 4 relative to the belt 1. These centering means include detection means (not shown) for detecting one of the side edges of the strip of flexible material 4.

For example, the detection means may consist of emit/receive cells fixed to the flanges (not shown) of a U-shaped bracket 9 disposed between the belt 1 and the roller 5 carrying the flexible material, and in substantially the same horizontal plane as said belt. The bracket 9 is itself fixed to a guide bar 10 over which the strip of flexible material 4 is caused to advance.

Figure 10:
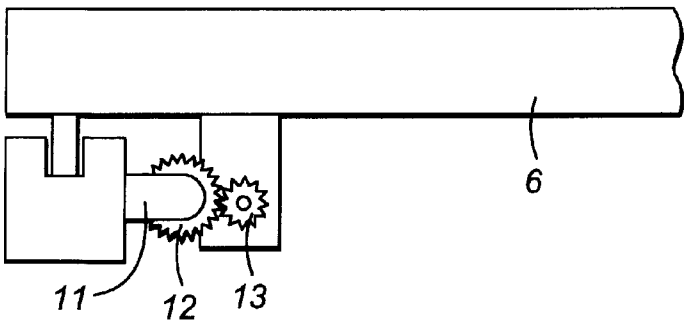
FIG. 10 is a diagram showing the means for transversely displacing the roller carrying the flexible material.

The centering means further include transverse displacement means (not shown) for transversely displacing the support frame 6 supporting the roller 5 carrying the flexible material, which displacement means are servo-controlled (not shown) to the above-mentioned detection means. As shown diagrammatically in FIG. 10, displacement means consist of a worm screw (not shown) rotated by means of a motor 11 via meshed gearing 12, 13.

The, gantry 14 for displacing the cutting head in longitudinal translation is driven conventionally via cog belts by means of a DC motor and of step-down means (not shown), along two longitudinal rails (not shown) disposed on either side of the belt 1.

The carriage 15 is also driven along the gantry via a cog-belt system by means of a DC motor and of step-down means (not shown).

The body 16*a* of a vertically-organized pneumatic actuator 16 is fixed to the carriage 15. A platform 17 supporting the cutting head 18 is fixed to the end of the rod 16*b* of the actuator.

While the actuator 16 is operating, the platform 17 is guided by means of two guide columns 19, 20 interconnecting two plates 21, 22, one plate being disposed above said platform and the other plate being disposed below said platform, the bottom plate 22 being secured to the body 16a of the actuator 16.

Figure 1:
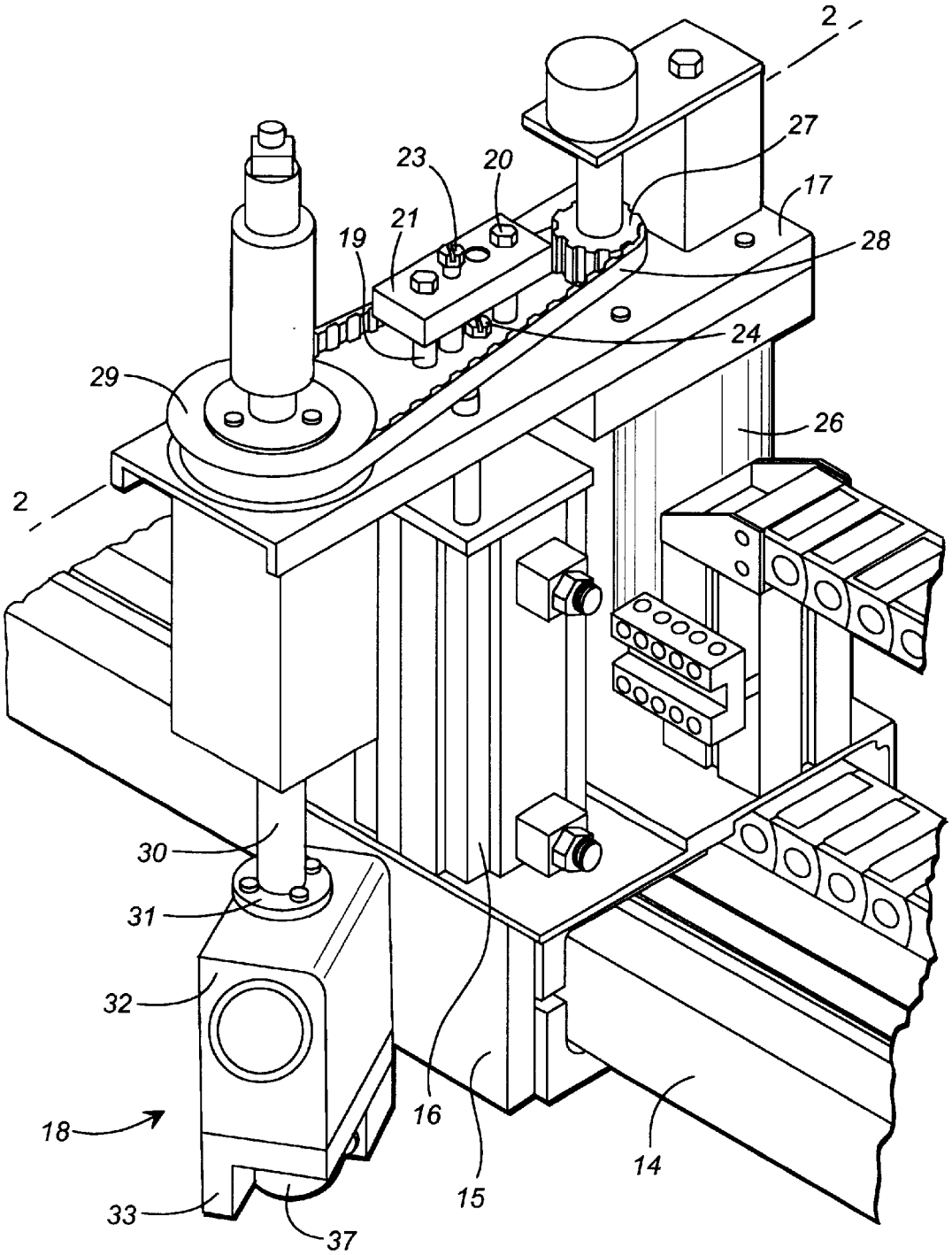
FIG. 1 is a fragmentary perspective view of the cutting head of a cutting machine of the invention, and of the means for horizontally displacing the cutting head.
Figure 2:
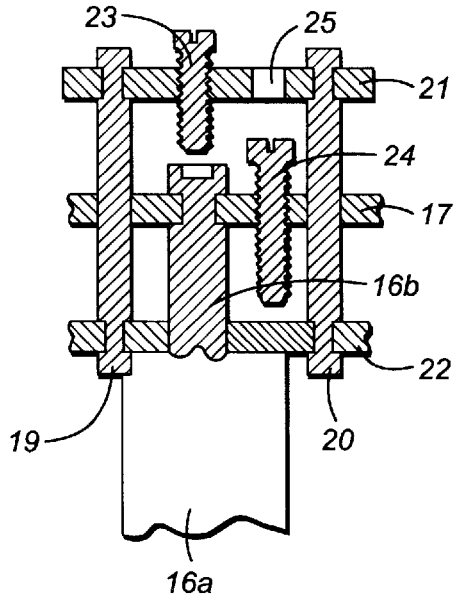
FIG. 2 is a fragmentary section view on a vertical plane A of FIG. 1, showing how the cutting head is fixed to the means for vertically displacing it.

Furthermore, as shown in FIG. 2, top abutment means 23 and bottom abutment means 24 are provided to allow the stroke of the pneumatic actuator 16 to be adjusted manually.

The top abutment means are constituted by a screw 23 received in a tapped bore provided in the top plate 21 facing the rod 16*b* of the actuator.

The bottom abutment means are constituted by a screw 24 received in a tapped bore provided in the platform 17 and adapted so as to come into abutment against the bottom plate 23 when the actuator 16 is retracted. In order to provide access to the screw 24 for adjusting the position of the bottom abutment by means of a screwdriver, the top plate 21 is provided with an orifice 25 facing said screw.

The platform 17 also carries the rotary drive means for rotating the cutting head about a vertical axis, which means are intended for angularly positioning the cutting wheel in the direction of the displacement.

The rotary drive means include a motor 26 having a shaft on which a sprocket 27 is mounted. The sprocket is coupled via a drive belt 28 to a toothed pulley wheel 29 that is prevented from moving in translation relative to the platform 17, and that is free to rotate relative thereto.

The rotary drive means further include a vertical shaft 30 secured to the toothed pulley wheel 29 and centered thereon, said shaft extending vertically beneath the platform 17 and being provided with a plate 31 at its bottom end, under which plate the cutting head 18 is fastened by screws.

It should be noted that the shaft 30 is hollow and it receives the compressed-air feed pipes and the electrical wires necessary for operating the cutting head 18.

The cutting head is composed of two elements: a fixed top element 32 secured to the plate 31, and a bottom element or slide 33 that is mounted to move relative to the fixed element 32 in the displacement direction of the cutting head l8.

The fixed element 32 is provided with a cavity for receiving an electric motor 34 for driving the cutting wheel at high speeds. The motor 34 is disposed horizontally and its drive shaft rotates a pulley 35.

The underside of the moving slide 33 is provided with a recess 36 for receiving the cutting wheel 37 which is organized so as to project from under said slide. The cutting wheel 37 is carried by a horizontal shaft 38 mounted to rotate by means of bearings such as 39 inside a bore 40 provided in the slide 33.

This shaft 38 further carries a pulley 41 coupled to the pulley 35 of the motor 34 via a belt 56 constituted by an O-ring.

It should also be noted that the motor 34 and the shaft 38 carrying the cutting wheel 37 are disposed such that the axis of rotation of said cutting wheel is offset horizontally by a distance D relative to the vertical axis of symmetry of the shaft 30, which vertical axis constitutes the tangential servo-control axis of the cutting wheel, the distance D being adjustable by displacing the slide 33.

Furthermore, the motor 34 is adapted so as to rotate the cutting wheel 37 in the same direction as the deployment direction of the cutting head 18, and with a linear peripheral velocity that is greater than that of said cutting head. In the example, the motor 34 generates torque that lies substantially in the range 4 cm.N to 6 cm.N, and it is adapted so as to drive the cutting wheel 37 at a linear velocity that is greater than 10 meters per second(m/s).

The speed of the motor is variable, either by varying its current feed or merely by means of a transformer having n positions making it possible to obtain n different speeds, so as to enable the speed of rotation of the cutting wheel 37 to be adjusted as a function of the cutting parameters (type of material to be cut, thickness, number of plies, etc.). It should be noted that said speed of rotation may also be modified by changing the ratio of the pulleys 35 and 41.

Figure 3:
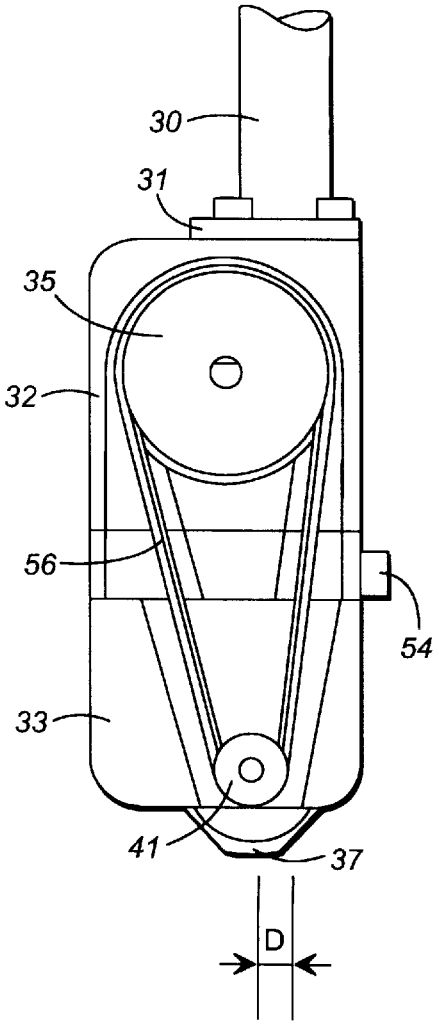
FIG. 3 is a side view of the cutting head.
Figure 4:
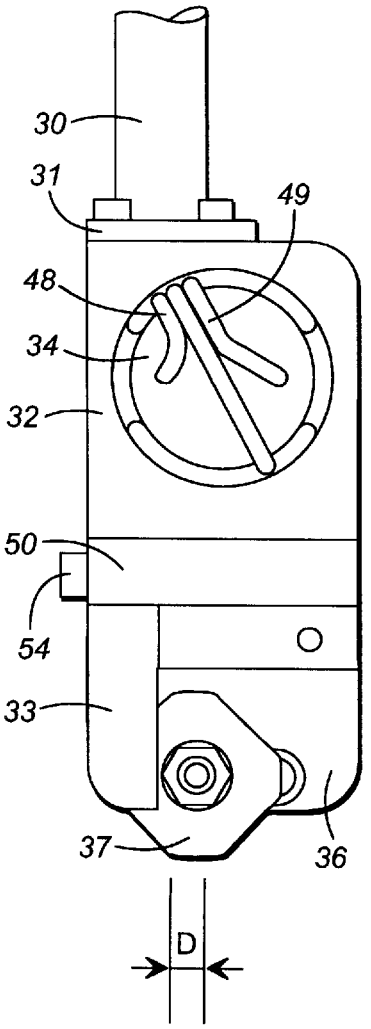
FIG. 4 is another side view showing the opposite face from that shown in FIG. 3.
Figure 5:
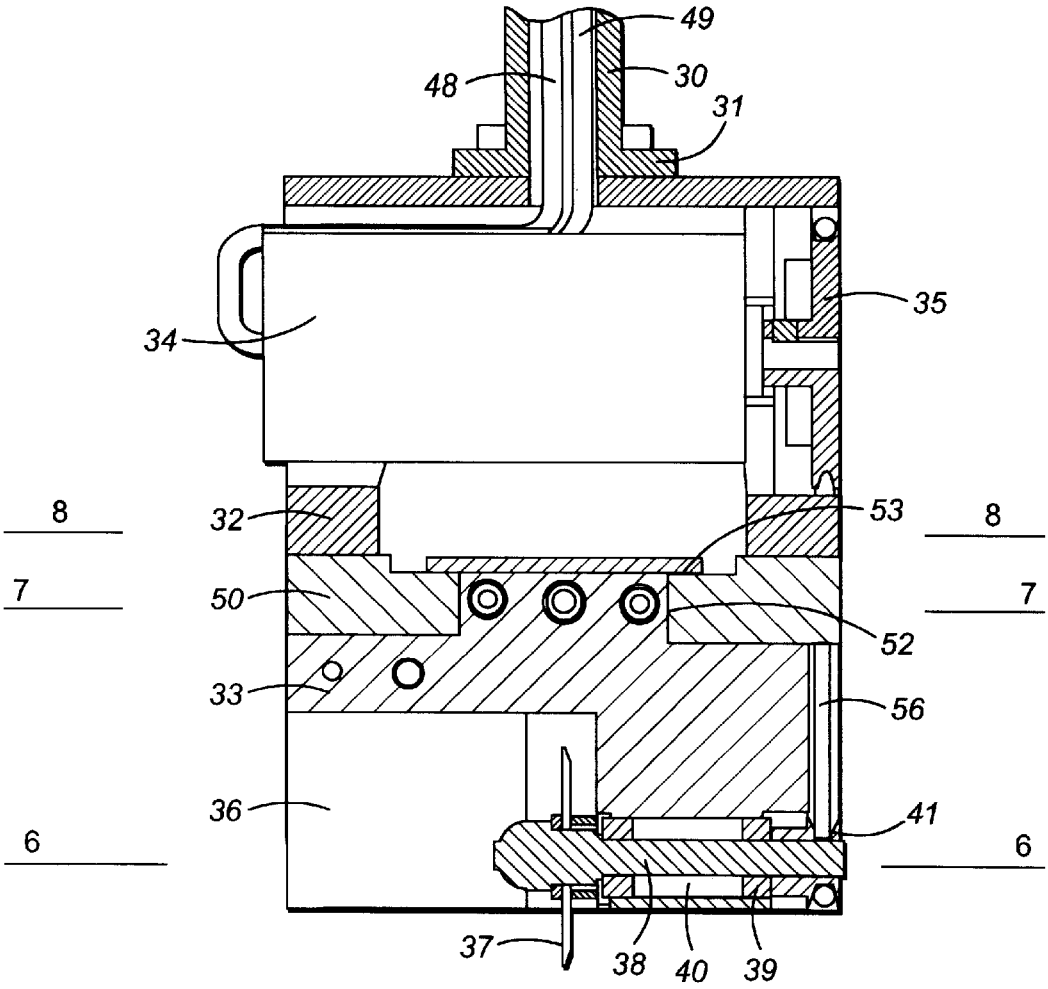
FIG. 5 is a longitudinal section through the cutting head on a vertical plane B.
Figure 6:
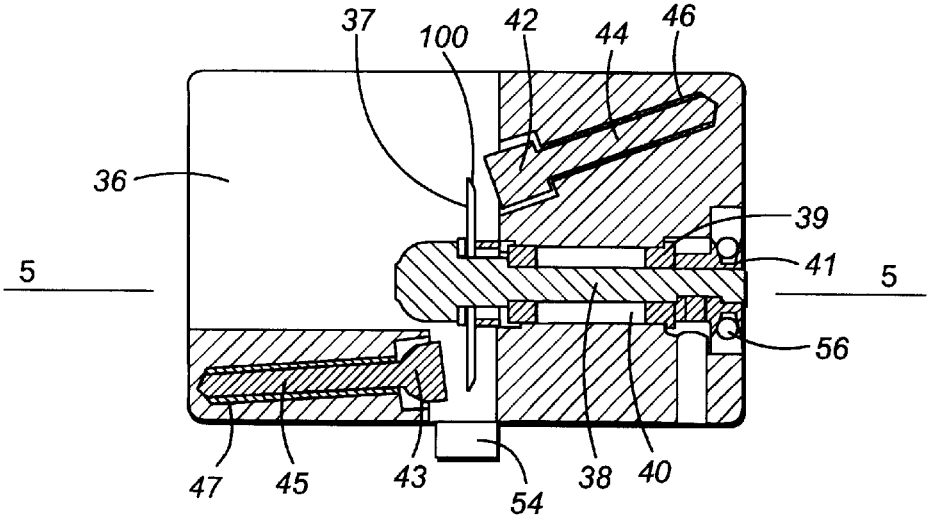
FIG. 6 is a cross-section on a horizontal plane C.
Figure 7:
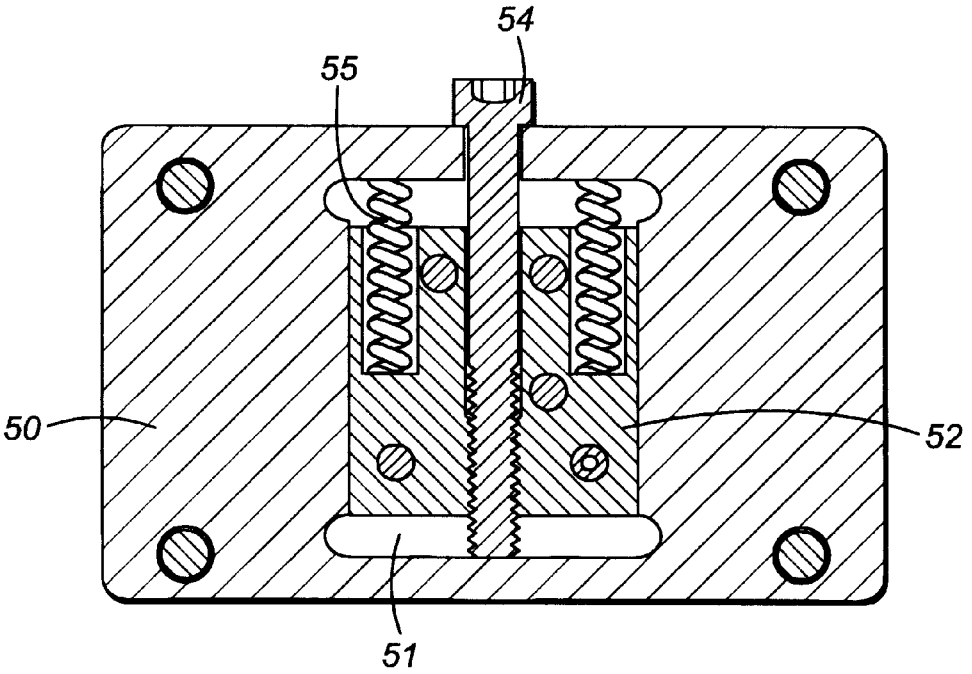
FIG. 7 is a cross-section on a horizontal plane D.
Figure 8:
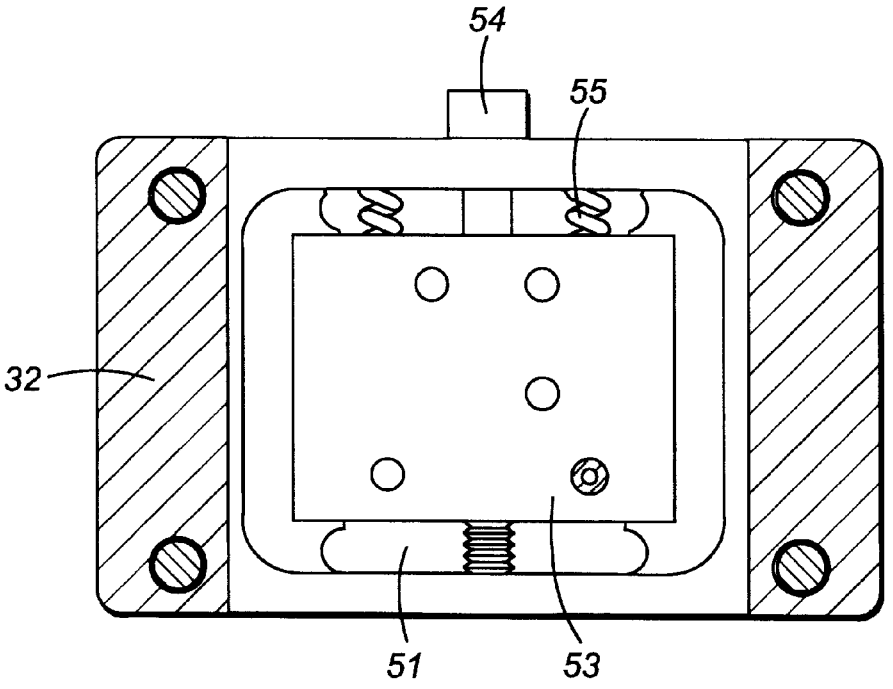
FIG. 8 is a across-section on a horizontal plane E.

As shown in FIGS. 3 and 4, the cutting wheel 37 is in the form an octagon composed of four circular-arc shaped sides interconnected in pairs by linear sides.

Such a cutting wheel 37 offers the advantage of not becoming clogged and of giving better cutting results, in particular with relatively hard materials such as vinyl, or synthetic materials of a certain thickness.

The moving slide 33 further carries sharpening means for sharpening the cutting wheel 37, which means comprise two grinding wheels 42, 43 mounted on respective pins 44, 45 received in respective blind holes 46, 47 provided on respective sides of the cutting wheel 37.

One of the grinding wheels 42 serves to give the cutting wheel its cutting angle 100, while the other grinding wheel performs a thread-cutting function. To this end, the blind holes 46, 47 are organized so that the whetting faces of the grinding wheels 42, 43 form different respective angles of inclination relative to the corresponding faces of the cutting wheel 37.

Thus, the blind holes 46, 47 are organized such that the whetting face of the sharpening grinding wheel 42 defines an angle substantially equal to 20 degrees with the corresponding face of the cutting wheel 37, and such that the whetting face of the thread-cutting grinding wheel 43 defines an angle substantially equal to 5 degrees with the other face of the cutting wheel.

Furthermore, the blind holes 46, 47 are organized such that the contact regions of the whetting faces of the grinding wheels 42, 43 are eccentric so that, on contact, the rotation of the cutting wheel 37 rotates said grinding wheels.

The means for displacing the grinding wheels 42, 43 so as to press them against the cutting wheel are of the pneumatic type, and they comprise compressed-air feed ducts such as 48, 49 opening out at the bottom of the blind holes 46, 47. Furthermore, the headloss in the ducts 48, 49 is adapted so that the compressed air pressure causing the thread-cutting grinding wheel 43 to be displaced is less than that causing the sharpening grinding wheel 42 to be displaced.

In order to enable the slide 33 to move relative to the fixed element 32, the two elements are interconnected by means of an intermediate part 50 fixed under the fixed element 32.

The intermediate part 50 is provided with a central opening 51 while the slide is provided with a tenon 52 that is shorter in length than the opening 51, and that is received therein, said slide being held by a plate 53 resting on the intermediate part 50 and fixed to the tenon 52. The displacements proper are performed manually by means of a screw 54 that co-operates with a tapped bore provided horizontally in the tenon 52 so that tightening or loosening said screw causes said tenon to slide inside the opening 51. In addition, springs such as 55 are disposed so as to guarantee that the tenon 52 does indeed move when the screw 54 is loosened.

Once the bottom abutment has been adjusted as a function of the thickness of the material to be cut, the screw 54 is used so that the front contact point of the cutting wheel 37 is situated in the vicinity of the tangential servo-control axis and slightly offset forwards relative thereto.

This adjustment possibility combined with the other characteristics of the cutting machine of the invention (the very high rotation speed of the cutting wheel 37, the quality of the sharpening of the cutting wheel, etc.) makes it possible to obtain an extremely attenuated cutting force, thereby achieving the desired result, namely making it unnecessary to hold the material to be cut.

I claim:

1. A cutting machine for cutting a flexible material in the form of a single ply or of a small lay-up of plies, said cutting machine comprising:

a table-top comprising a support surface for supporting the flexible material to be cut;

a cutting head comprising a cutting wheel, a drive motor for rotating said cutting wheel, and sharpening means for sequentially sharpening said cutting wheel;

horizontal drive means for horizontally displacing said cutting head above said table-top along two orthogonal displacement axes; and rotary drive means for rotating said cutting head about a vertical tangential servo-control axis;

said cutting machine further comprising:

said table-top comprising a support material of predetermined thickness into which said cutting wheel can penetrate easily;

said cutting head comprising a carriage to which it is connected via a vertical displacement means capable of displacing said cutting head between a top position in which said cutting wheel is at a distance above said table-top, and a bottom position in which said cutting wheel penetrates to a predetermined depth into said support material;

said vertical adjustment means are adapted so as to make it possible to adjust the bottom position of the cutting head, and therefore the depth to which said cutting wheel penetrates into said support material;

said drive motor for rotating said cutting wheel is carried by said cutting head and is capable of rotating said cutting wheel at a speed greater than 5,000 rpm, said motor and said cutting wheel being respectively provided with a drive shaft and an axis of rotation that are parallel and horizontal;

said rotary drive means for rotating said cutting head are organized so that said tangential servo-control axis of said cutting wheel is offset horizontally at a distance (D) relative to the axis of rotation thereof, so that said cutting wheel penetrates into said support material at a front contact point situated in the vicinity of said tangential servo-control axis; and horizontal adjustment means are adapted so as to make it possible to adjust the distance between said tangential servo-control axis and said axis of rotation of said cutting wheel.

2. The cutting machine of claim 1, wherein said support surface supports said material to be cut without the use of hold down means.

* * * * *